United States Patent [19]

McMahon

[11] Patent Number: 5,014,497

[45] Date of Patent: May 14, 1991

[54] METHOD AND APPARATUS FOR SMOOTHING OF BAG MAKING MATERIAL IN FORM, FILL AND SEAL MACHINES

[75] Inventor: Michael J. McMahon, Palatine, Ill.

[73] Assignee: Zip-Pak, Incorporated, Northbrook, Ill.

[21] Appl. No.: 490,839

[22] Filed: Mar. 6, 1990

[51] Int. Cl.[5] ..... B65B 9/06

[52] U.S. Cl. ..... 53/451; 53/479; 53/551; 53/370.7; 493/193; 493/206; 493/208; 493/209; 493/406; 493/466

[58] Field of Search ..... 53/371, 373, 450, 451, 53/469, 479, 550, 551, 552, 554, 562, 570; 493/193, 206, 208, 209, 406, 466

[56] References Cited

U.S. PATENT DOCUMENTS

| | | | |
|---|---|---|---|
| 4,174,599 | 11/1979 | Callet et al. | 53/570 |
| 4,534,159 | 8/1985 | Kelly | 53/552 |
| 4,704,845 | 11/1987 | Bruno | 53/371 |
| 4,768,330 | 9/1988 | Lane, Jr. et al. | 53/373 |
| 4,829,745 | 5/1989 | Behr et al. | 53/551 |
| 4,829,746 | 5/1989 | Schmidt et al. | 53/451 |
| 4,869,048 | 9/1989 | Boeckmann | 53/551 |

FOREIGN PATENT DOCUMENTS

| | | | |
|---|---|---|---|
| 892537 | 3/1962 | United Kingdom | 493/206 |

*Primary Examiner*—Robert L. Spruill
*Assistant Examiner*—Daniel B. Moon
*Attorney, Agent, or Firm*—Hill, Van Santen, Steadman & Simpson

[57] ABSTRACT

A device for assuring substantial smoothness in bags formed on a form, fill and seal machine comprising structure engageable with a closure along one edge of flattened bag making material below a forming and filling tube, and cooperating members operating cyclically from a position at the stabilizer in a flattening stroke across the material. The flattening members are desirably rollers which may be heated to effect a flatness retaining seal across the flattened material.

20 Claims, 1 Drawing Sheet

METHOD AND APPARATUS FOR SMOOTHING OF BAG MAKING MATERIAL IN FORM, FILL AND SEAL MACHINES

BACKGROUND OF THE INVENTION

This invention relates to improvements in smoothing of bag making material in form, fill and seal machines wherein bag making film material is formed into bags filled with product after descending from a form, fill tubular nozzle toward bag sealing means.

Examples of form, fill and seal bag making and filling machines especially relevant to the present invention are disclosed in U.S. Pat. Nos. 4,355,494 and 4,829,745, which to any extent necessary are incorporated herein by reference so that the present invention may be more succinctly disclosed herein.

The problem to which the present invention is directed is elaborately described in the aforesaid U.S. Pat. No. 4,829,745, namely that wrinkles tend to form along the edge seal lines of the bags produced as a result of the operation of the form, fill and seal machines wherein the tube of bag making material is, after it descends below the discharge end of the form and fill tube, sealed thereacross by sealing form means to form one side of a bag and then filled and sealed across to form the opposite side of the bag. As disclosed in that patent, gripper means at one side of the flattened tube and a swinging arm inside the tube cooperate to maintain a flat configuration of the bag making material relative to the sealing jaw means. That arrangement, while reasonably effective, requires mechanism functioning within the filling area of the form and fill tubular nozzle, and the present invention aims to avoid that complication.

SUMMARY OF THE PRESENT INVENTION

An important object of the present invention is to provide a new and improved device and method for assuring substantially smooth bags formed on a form, fill and seal machine.

Another object of the present invention is to provide new and improved means and method for assuring substantial smoothness in the bags produced during operation of a form, fill and seal machine.

Still another object of the invention is to provide means which functions at the outside of bag making material for assuring smoothness in the bags produced in a form, fill and seal machine.

Yet another object of the present invention is to provide new and improved means and method for concurrently smoothing and sealing flattened bag making material below the discharge end of a form, fill and seal machine tubular forming and filling nozzle member.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which.

DETAILED DESCRIPTION

Figure 1:
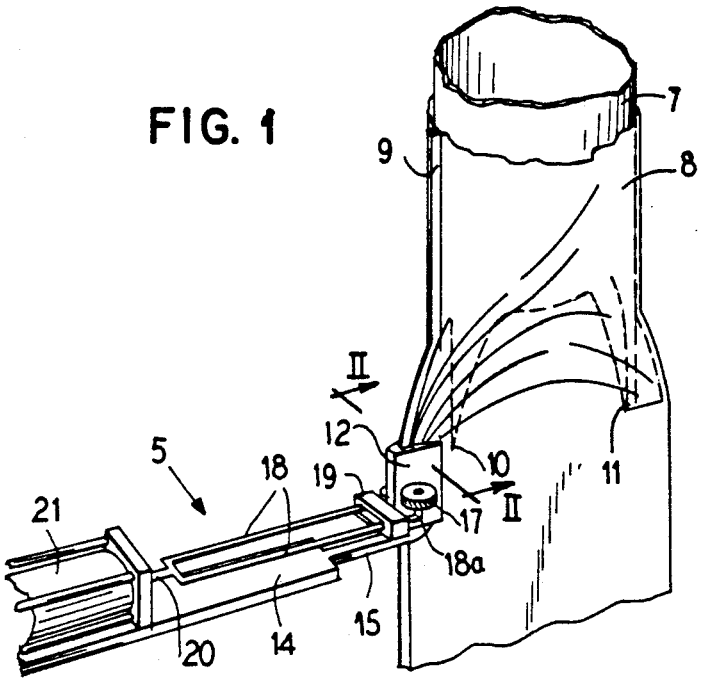
FIG. 1 is a fragmentary, more or less schematic, perspective view embodying the present invention.

A device 5 (FIG. 1) embodying the present invention is disclosed in association with the discharge end of a tubular forming and filling chute or nozzle 7 about which bag making material 8 is in free tubular embrace having been formed up about the tube 7 in the usual fashion wherein the material is fed to the tube 7 in sheet form and edges of the sheet are brought together in a closure 9. Whereas the closure 9 may be simply in the form of a sealed fin, it may also be a reclosable plastic zipper wherein complementary zipper profiles are reclosably interlocked. In any event, the fin 9 becomes the closure for the mouth ends of the bags to be formed from the bag making material 8.

At the discharge end of the tube 7, means are provided for shaping the bag making material 8 into substantially flattened form to facilitate the bag making process. To this end, the lower extremity of the tube 7 has aligned spreaders 10 and 11 which are desirably substantially similar oppositely extending spreader fins. The spreader fin 10 guides the portion of the material 8 having the closure 9 laterally into one edge of the flattened material 8, while the spreader fin 11 guides the opposite portion of the material 8 into an opposite edge of the flattened material.

Figure 2:
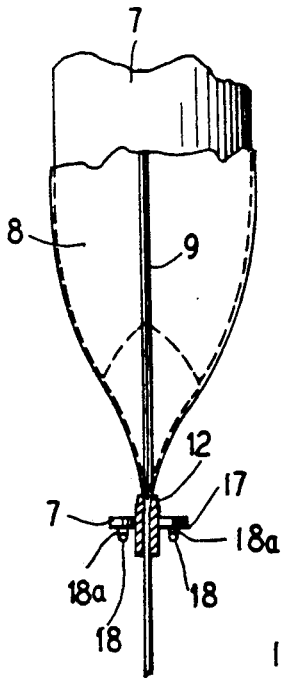
FIG. 2 is a sectional elevational view taken substantially along the line II—II in FIG. 1.
Figure 4:
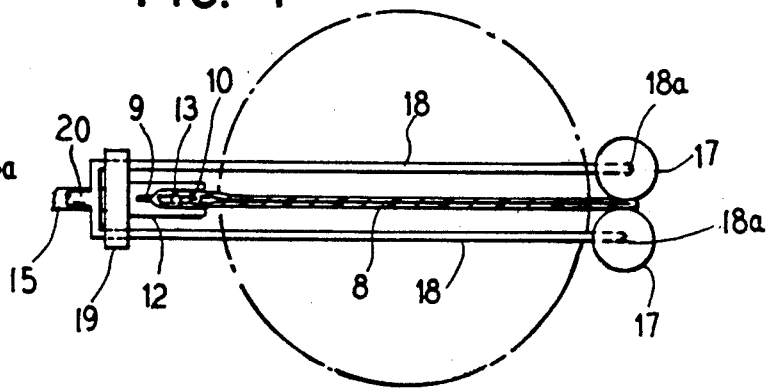
FIG. 4 is a fragmentary sectional plan view taken substantially along the line IV—IV in FIG. 3.

Cooperating with the spreader fin 10 is a bifurcated stabilizer bar 12 which, as best seen in FIGS. 2 and 4 has a fin receiving guide slot 13 complementary to the fin 10 and the closure 9. A frame member 14 supports the bar 12 in operative position by means of a supporting arm 15.

Figure 3:
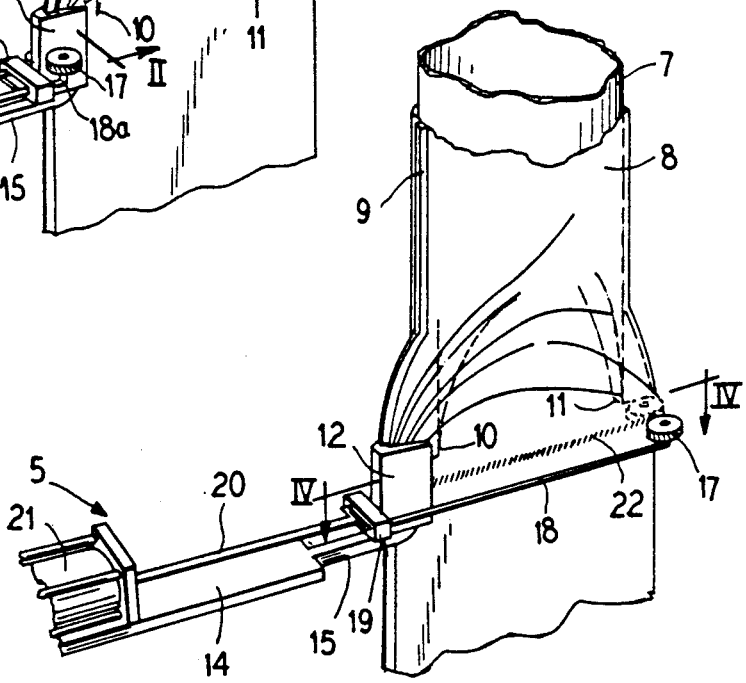
FIG. 3 is a view similar to FIG. 1 but showing the device of the invention in an operating mode.

Means comprising rollers 17 are provided cooperative with the spreader fins 10 and 11 and the stabilizer 12 for smoothing the flattened material 8. To this end, the rollers 17 are carried rotatably on the ends of reciprocatable rod arms 18 bracketing the stabilizer 12 therebetween and guided by means of a guide block 19 which may be supported on the arm 15 immediately adjacently in back of the stabilizer 12. Reciprocation of the arms 18 is effected by means comprising a piston rod 20 operable by means of a fluid operated actuator 21 desirably fixedly mounted on the frame 14. The arrangement is such that the roller arms 18 are adapted to be cyclically driven between a starting position of the rollers 17 resting in clearance relation on the stabilizer 12 as shown in FIG. 1, to a fully extended position as shown in FIGS. 3 and 4, and returned to the starting position in a cycle of operation stroke coordinated in operation with the associated machine, and more particularly the discharge of product into the immediately trailing bag after the filled lead bag has been sealed and cut off from the trailing bag, in the conventional manner. In each operating stroke of the rollers 17 from the retracted position at the stabilizer 12, into the fully extended position at the edge of the flattened material 8 opposite to the closure edge 9, the rollers function to smooth the flattened material 8 and thus assure that the bags as formed will be substantially smooth, that is, the walls of the bags will be substantially free from wrinkle tucks or pleats or other distortions that may result from puffing or stretching of the bag material during filling of the bag.

Desirably, not only do the rollers 17 effect smoothing of the flattened material 8, but also effect an at least preliminary sealing 22 across the flattened material 8. Such sealing is desirably effected across that portion of the flattened material 8 that provides for the final side seal of the lead bag and the adjacent side seal of the following bag, thereby holding the desirably flattened condition of the material until conventional sealing bars may effect final sealing of the material. To enable the rollers to effect the sealing they are adapted to be heated as by having the actuating rods 18 or at least axles 18*a* for the rollers or the rollers themselves provided with heating means of conventional form.

Thus, it is apparent that the present invention provides a simple, efficient, easily accessible device for smoothing the flattened bag making material below the forming and filling tube of the associated form, fill and seal machine.

It will be understood that variations and modifications may be effected without departing from the spirit and scope of the novel concepts of the present invention.

I CLAIM AS MY INVENTION:

1. A device for assuring substantial smoothness in bags formed on a form, fill and seal machine, and wherein bag making film material having closure means travels downwardly in substantially flattened form from the discharge end of tubular form, fill nozzle means which is loosely embraced by the travelling film material, said flattened material having said closure means along one edge and there being an opposite edge along the flattened material, the device comprising:

means for engaging said one edge of the flattened material against displacement; and means movable from said closure means edge-engaging means transversely across said flattened material toward said opposite edge of the flattened material for smoothing the flattened material.

2. A device according to claim 1, wherein said means for engaging said one edge of the flattened material comprises a stabilizer block structure, and means for supporting said structure.

3. A device according to claim 2, in combination with a forming and sealing tube of a form, fill and seal machine, said tube having a spreader fin engaging said one edge of the flattened material in cooperation with said stabilizer block structure.

4. A combination according to claim 3, wherein said smoothing means comprises cooperatively related members and means for cyclically operating said members from a starting position at said stabilizer block structure and across said flattened material to a finished position at the opposite edge of the flattened material adjacent to a second spreader fin on said tube.

5. A combination according to claim 4, wherein said flattening members comprise rollers.

6. A combination according to claim 5, including means for heating said rollers so that the rollers will effect a preliminary seal across the flattened material.

7. A device according to claim 1, wherein said means for engaging said one edge of the flattened material comprises a stabilizer means, and said means for smoothing comprises a pair of cooperative smoothing members cyclically operable from a position at said stabilizer means to a position at said opposite edge of the flattened material.

8. A device according to claim 7, wherein said cooperative members comprise rollers which roll across said flattened material.

9. A device according to claim 8, including means for heating said rollers for effecting a preliminary seal across said flattened material.

10. A method of assuring substantial smoothness in bags formed on a form, fill and seal machine, and wherein bag making film material having closure means travels downwardly in substantially flattened form from the discharge end of tubular form, fill nozzle means which is loosely embraced by the travelling film material, said flattened material having said closure means along one edge and there being an opposite edge along the flattened material, the method comprising:

engaging said one edge of the flattened material against displacement; and smoothing the flattened material by moving a smoothing means from said one edge transversely across said flattened material toward said opposite edge of the flattened material.

11. A method according to claim 10, comprising engaging said one edge of the flattened material by a stabilizer block structure.

12. A method according to claim 11, comprising, engaging said edge of the flattened material with a spreader fin on the forming and sealing tube of the form, fill and seal machine cooperating with said block structure.

13. A method according to claim 12, comprising, effecting said smoothing by means of cooperatively related members and cyclically operating said members from a starting position at said block structure and across said flattened material to a finished position at the opposite edge of the flattened material to a spreader fin on said tube cooperating with said first mentioned spreader fin.

14. A method according to claim 13, comprising providing said cooperatively related members as rollers, and operating said rollers across said material.

15. A method according to claim 14, comprising, heating said rollers so that the rollers will effect a preliminary seal across the flattened material.

16. A method according to claim 10, comprising, engaging said one edge of the flattened material by a stabilizer means, and effecting said smoothing by means of a pair of cooperative smoothing members cyclically operated from a position at said stabilizer means to a position at said opposite edge of the flattened material.

17. A method according to claim 16, comprising, operating said cooperative members in the form of rollers which roll across said flattened material.

18. A method according to claim 17, comprising, heating said rollers for effecting a seal across said flattened material.

19. A method of assuring substantial smoothness in bags formed from bag making film material on a form, fill and seal machine, comprising:

flattening the material below the discharge end of form fill nozzle means of the machine;

holding one edge of the flattened material against displacement; and smoothing the material by running smoothing means across the flattened material from said held one edge of the flattened material to the opposite edge of the flattened material.

20. A method according to claim 19, which includes heat sealing the flattened material concurrently with said flattening.

* * * * *